US010709264B1

(12) United States Patent
Nagel et al.

(10) Patent No.: US 10,709,264 B1
(45) Date of Patent: Jul. 14, 2020

(54) RETAIL MERCHANDISE TRAY AND DISPLAY INCORPORATING SAME

(71) Applicants: Thomas O. Nagel, Rockford, IL (US); Brent O. Ewing, Aurora, OH (US)

(72) Inventors: Thomas O. Nagel, Rockford, IL (US); Brent O. Ewing, Aurora, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 0 days.

(21) Appl. No.: 16/827,314

(22) Filed: Mar. 23, 2020

Related U.S. Application Data

(63) Continuation of application No. 15/838,674, filed on Dec. 12, 2017, now Pat. No. 10,638,856.

(60) Provisional application No. 62/442,741, filed on Jan. 5, 2017.

(51) Int. Cl.

| | |
|---|---|
| ***A47F 1/12*** | (2006.01) |
| ***A47F 5/00*** | (2006.01) |
| ***A47F 5/16*** | (2006.01) |
| *A47B 57/58* | (2006.01) |

(52) U.S. Cl.
CPC ..... *A47F 1/126* (2013.01); *A47F 5/005* (2013.01); *A47F 5/0025* (2013.01); *A47F 5/16* (2013.01); *A47B 57/585* (2013.01); *A47F 2005/165* (2013.01)

(58) Field of Classification Search
CPC ..... A47F 1/126; A47F 5/0025; A47F 5/005; A47F 5/16; A47F 2005/165; A47B 57/585
USPC ... 211/59.2, 59.3, 184, 71.01, 72, 74, 126.1, 211/126.16, 151; 108/60, 61; 312/35, 72
See application file for complete search history.

(56) References Cited

U.S. PATENT DOCUMENTS

| | | | | | |
|---|---|---|---|---|---|
| 3,229,334 | A * | 1/1966 | Manfred | B65D 9/34 | 403/173 |
| 3,872,802 | A | 3/1975 | Scheerhorn | | |
| 3,986,616 | A | 10/1976 | Gray | | |
| 4,205,763 | A | 6/1980 | Merl | | |
| 4,454,948 | A | 6/1984 | Spamer | | |
| 4,461,388 | A | 7/1984 | Bustos | | |
| 4,696,406 | A | 9/1987 | Karashima | | |
| 4,706,824 | A * | 11/1987 | Mercer | A47F 5/118 | 108/186 |
| 4,736,997 | A | 4/1988 | Besore | | |
| 4,830,201 | A | 5/1989 | Breslow | | |
| 4,960,210 | A | 10/1990 | Spamer | | |
| 5,160,051 | A | 11/1992 | Bustos | | |
| 5,390,802 | A * | 2/1995 | Pappagallo | A47B 45/00 | 211/187 |

(Continued)

FOREIGN PATENT DOCUMENTS

KR 949574 3/2010

OTHER PUBLICATIONS

U.S. Appl. No. 15/838,674, filed Dec. 12, 2017.

*Primary Examiner* — Jonathan Liu
*Assistant Examiner* — Devin K Barnett
(74) *Attorney, Agent, or Firm* — Reinhart Boerner Van Deuren P.C.

(57) ABSTRACT

A retail merchandise tray and display incorporating the same are provided. The display includes a shelf and the tray mounted to the shelf. The tray includes a pair of opposed mounting rails with at least one tray section situated between the first and second mounting rails. A support leg is mounted to the first mounting rail and elevates a back end of the retail merchandise tray relative to a front end.

16 Claims, 9 Drawing Sheets

(56) References Cited

U.S. PATENT DOCUMENTS 5,673,801 A 10/1997 Markson
5,813,738 A * 9/1998 Cheng ..... F16B 12/14 312/257.1
5,862,923 A 1/1999 Nordquist
6,082,557 A 7/2000 Leahy
6,098,821 A 8/2000 Dube
6,129,218 A 10/2000 Henry
6,132,158 A 10/2000 Pfeiffer
6,234,328 B1 5/2001 Mason
6,431,808 B1 8/2002 Lowrey
6,497,326 B1 12/2002 Osawa
6,523,703 B1 2/2003 Robertson
7,140,499 B2 11/2006 Burke
8,042,700 B1 * 10/2011 Smalley ..... A47F 5/0807 211/88.01
8,490,800 B2 7/2013 Noble Colin
8,573,379 B2 11/2013 Brugmann
8,915,381 B2 12/2014 Brozak
9,016,482 B2 4/2015 Kim
9,038,804 B1 * 5/2015 Nickell ..... B65G 13/11 193/35 R
9,370,242 B2 * 6/2016 Guizzardi ..... A47B 87/0223
9,986,854 B2 6/2018 Riley
10,034,557 B1 7/2018 Nagel
10,154,739 B2 12/2018 Turner
10,178,909 B2 1/2019 Hardy
10,206,520 B2 2/2019 Hardy
10,251,493 B2 * 4/2019 Kim ..... B65G 13/11
2002/0088762 A1 7/2002 Burke
2003/0066811 A1 4/2003 Dimattia
2003/0132182 A1 * 7/2003 Jay ..... A47F 5/0043 211/175
2004/0000528 A1 1/2004 Nagel
2004/0050811 A1 3/2004 Leahy
2004/0065631 A1 4/2004 Nagel
2004/0118795 A1 6/2004 Burke
2004/0159622 A1 8/2004 Craft
2004/0178156 A1 9/2004 Knorring, Jr.
2004/0245197 A1 12/2004 McElvaney
2005/0077260 A1 4/2005 Mueller
2005/0189310 A1 9/2005 Richter
2005/0236351 A1 * 10/2005 Curatolo ..... E04F 11/108 211/186
2006/0037832 A1 2/2006 Lawless
2006/0169659 A1 * 8/2006 Robinson ..... A47B 57/30 211/187
2006/0186064 A1 8/2006 Merit
2006/0186065 A1 8/2006 Ciesick
2007/0029270 A1 2/2007 Hawkinson
2007/0045209 A1 3/2007 Richardson
2007/0080126 A1 4/2007 Music
2007/0090068 A1 4/2007 Hardy
2007/0158281 A1 7/2007 Hardy
2009/0242582 A1 10/2009 Vlastakis
2009/0294392 A1 12/2009 Stafford
2010/0072152 A1 3/2010 Kim
2010/0078402 A1 4/2010 Davis
2010/0116760 A1 * 5/2010 Fazzone ..... A47F 5/005 211/49.1
2010/0133214 A1 * 6/2010 Evans ..... A47B 96/021 211/85.8
2010/0133219 A1 6/2010 Sun
2010/0206829 A1 8/2010 Clements
2010/0258513 A1 10/2010 Meyer
2011/0055103 A1 3/2011 Swafford, Jr.
2011/0100941 A1 5/2011 Luberto
2011/0100942 A1 5/2011 Spizman
2011/0174750 A1 7/2011 Poulokefalos
2011/0186401 A1 * 8/2011 Brugmann ..... A47F 1/125 193/37
2011/0204012 A1 * 8/2011 Eguchi ..... A47F 11/10 211/85.8
2011/0278246 A1 11/2011 Daily
2011/0291540 A1 * 12/2011 Davidson ..... A47B 96/021 312/350
2012/0000872 A1 1/2012 Troyner
2012/0091162 A1 4/2012 Overhultz
2012/0118840 A1 5/2012 Howley
2012/0217212 A1 8/2012 Czalkiewicz
2013/0015155 A1 * 1/2013 Brugmann ..... B65G 1/023 211/151
2013/0112640 A1 5/2013 Desmond
2013/0213916 A1 8/2013 Leahy
2014/0299560 A1 10/2014 Kim
2014/0319087 A1 10/2014 Sosso
2015/0053633 A1 2/2015 McDonnell
2015/0041418 A1 4/2015 Nickell
2015/0114918 A1 4/2015 Nickell
2015/0238026 A1 * 8/2015 Chambers ..... A47F 5/005 211/59.3
2015/0289683 A1 10/2015 Walker
2015/0359358 A1 12/2015 Miller, Jr.
2016/0029794 A1 2/2016 Obitts
2016/0066688 A1 * 3/2016 Yu ..... A47B 47/0075 312/263
2016/0296039 A1 10/2016 Bird
2017/0164762 A1 6/2017 Bryson
2017/0280894 A1 10/2017 Kim et al.
2017/0295958 A1 10/2017 Hassell
2018/0153313 A1 6/2018 Padvoiskis
2018/0310707 A1 * 11/2018 Berloni ..... F16B 12/2063
2019/0387733 A1 * 12/2019 Lykken ..... A01M 25/004
2020/0100588 A1 * 4/2020 Reinhart ..... A47B 96/024

* cited by examiner

RETAIL MERCHANDISE TRAY AND DISPLAY INCORPORATING SAME

CROSS-REFERENCE TO RELATED PATENT APPLICATION

This patent application is a continuation of U.S. patent application Ser. No. 15/838,674, filed Dec. 12, 2017, which claims the benefit of U.S. Provisional Patent Application No. 62/442,741, filed Jan. 5, 2017, the entire teachings and disclosure of which are incorporated herein by reference thereto.

FIELD OF THE INVENTION

This invention generally relates to retail merchandise displays, and more particularly to retail merchandise trays used to face linear rows of merchandise.

BACKGROUND OF THE INVENTION

Retail merchandise trays are typically used to contain retail merchandise in neat organized linear rows. Such trays may employ spring biased pushers to front face the merchandise, i.e. move the merchandise forward to a front of the tray, by applying a force to the back end of each row of merchandise. Other trays may forego the use of a pusher entirely, and rely on gravity for front facing. The latter style of tray is commonly referred to in the industry as a tray.

While such trays are advantageous, they are not without their drawbacks. First, such trays are typically designed as a stand-alone shelf. In other words, they are not designed to mate with an existing retail shelf. Instead, they require their own custom vertical mounting rack, with each tray mounted directly to the vertical mounting rack. A contemporary example of such a system may be readily seen at U.S. Pat. No. 8,490,800 to Noble Cohn titled "Gravity Feed Display Rack," the teachings and disclosure of which are incorporated in their entirety by reference herein. As such, one drawback is that such gravity feed systems are difficult to integrate with existing retail shelving.

Second, even where such trays are designed to operate with an existing retail shelf, they are relatively complex in their construction and typically require hand tools and the like in their assembly. An example of such a relatively complex system may be seen at U.S. Patent Application Publication No. 2004/0178156 to Knorring, J R. et al. titled "Method and Apparatus For Converting Gondola Shelf to Gravity Feed Shelf," the teachings and disclosure of which are incorporated in their entirety by reference herein. Such systems often entail a high part count to effectuate installation to a shelf, as well as the use of relatively complex componentry such as rollers and the like. Further such systems often require the use of fasteners in their assembly which requires the use of additional tools and labor.

Accordingly, there is a need in the art for a retail merchandise tray and display incorporating the same which alleviates or eliminates the above drawbacks. The invention provides such a tray and display incorporating the same. These and other advantages of the invention, as well as additional inventive features, will be apparent from the description of the invention provided herein.

BRIEF SUMMARY OF THE INVENTION

In one aspect, the invention provides a retail merchandise display which may be fully integrated with an existing retail display system, e.g. a shelving unit. An embodiment of such a retail merchandise display includes a retail shelf. The display also includes a tray mounted to the retail shelf. The tray includes a linear row of mounting slots extending generally perpendicular to a feed direction of the tray. The display also includes a plurality of mounting plates interposed between the tray and the retail shelf. Each of the plurality of mounting plates includes at least one projection projecting upwardly from a base portion. The at least one projection is slidably received in one of the mounting slots of the tray.

In an embodiment according to this aspect, the retail shelf includes an array of apertures therein. Each one of the plurality of mounting plates includes a pair of bent portions which are received in adjacent ones of the array of apertures to anchor each one of the mounting plates to the shelf. The bent portions extend away from the base portion. The bent portions are coplanar with one another and not coplanar with the base portion.

In an embodiment according to this aspect, the tray includes a first and a second mounting rail. The first mounting rail is situated at a rear of the tray. The second mounting rail is situated at a front of the tray. The tray includes at least one tray section interposed between and mounted to the first and second mounting rails. The at least one tray section mounts to the first and second mounting rails by a resilient snap-fit connection.

In an embodiment according to this aspect, one of the plurality of mounting plates is used per one of the at least tray sections to mount the tray to the retail shelf.

In another aspect, a retail merchandise tray is provided which advantageously has a reduced part count compared to existing tray systems. An embodiment of such a retail merchandise tray includes a first and a second mounting rail arranged in an opposed spaced relationship such that the first mounting rail is situated at a back end of the retail merchandise tray and the second mounting rail is situated at a front of the retail merchandise tray. The retail merchandise tray also includes at least one tray section mounted to and interposed between the first and second mounting rails. The at least one tray section provides a continuous retail merchandise support surface extending between the front and the back end.

In an embodiment according to this aspect, the first and second mounting rails are identical. The first and second mounting rails each include a mounting channel, an upper channel, and a lower channel. The mounting channel is configured to receive at least one tray section such that the at least one tray section mounts within the mounting channel using a resilient snap-fit connection. The retail merchandise tray also includes a support leg mounted to the first mounting rail. The support leg elevates the back end relative to the front end such that the back end is elevated above the front end. The support leg mounts to the lower channel of the first mounting rail via a resilient snap-fit connection. The support leg includes a leg portion and a foot portion extending perpendicular to the leg portion. The support leg includes a projection projecting from an end of the leg portion. The projection is received within the lower channel of the first mounting rail.

In an embodiment according to this aspect, the retail merchandise tray can also include a front stop. The front stop is received within the upper channel of the second mounting rail.

In an embodiment according to this aspect, the retail merchandise tray also includes a plurality of wire supports received in channels formed in a base member of the at least one tray section. The plurality of wire supports are contained within the channels by a pair of cap members mounted to the base member such that the base member is interposed between the pair of cap members.

In yet another aspect, the invention provides a retail merchandise tray which advantageously does not require any mounting hardware in its assembly. An embodiment of such a retail merchandise tray includes a first and a second mounting rail arranged in an opposed spaced relationship such that the first mounting rail is situated at a back end of the retail merchandise tray and the second mounting rail is situated at a front end of the retail merchandise tray. At least one tray section is mounted to and interposed between the first and second mounting rails. The at least one tray section includes a base member having a plurality of hollow channels and defining a continuous retail merchandise support surface. The at least one tray section also includes a pair of cap members. The pair of cap members are mounted to the base member such that the base member is interposed between the pair of cap members. The at least one tray section also includes at least one divider extending over the retail merchandise support surface and mounted to each of the pair of cap members. Each of the pair of cap members mounts to the base member using a resilient snap-fit connection. The at least one tray section mounts to the first and second mounting rails using a resilient snap-fit connection.

The resilient snap-fit connection between the base member and each of the pair of cap members is formed by a tab formed on each of the pair of cap members and corresponding apertures formed in the base member. The tab and aperture are configured such that the tab resiliently snaps into the aperture. The tab of each cap member is formed on a projection of each cap member. The projection is received within an elongated channel of the base member.

In an embodiment according to this aspect, the resilient snap-fit connection between the at least one tray section and the first and second mounting rails is formed by a tab formed on each of the pair of cap members on a projection portion thereof and an aperture formed within a mounting channel of each of the first and second mounting rails. The projection portion is insertable into the mounting channel such that the tab resiliently snaps into the aperture.

In an embodiment according to this aspect, the first and second mounting rails are identical. Also in an embodiment according to this aspect, the at least one divider may include an integrated pusher assembly. The integrated pusher assembly includes a pusher paddle slidably received within a slot of a divider wall of the at least one divider. The pusher assembly also includes a coil spring operably coupled between the pusher paddle and the divider wall.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, an embodiment of a retail merchandise display 20 is illustrated which includes a retail merchandise tray 22 (hereinafter referred to as a "tray") mounted on a retail merchandise shelf 24. Advantageously, tray 22 does not require any mounting hardware in its assembly. By "mounting hardware" it is meant screws, bolts, rivets, or any other component which a tool is typically required to install. Instead, tray 22 employs resilient snap-fit connections to connect its various components. As a result, no hand tools are required in the assembly and installation of tray 22. Put differently, retail merchandise display 20 advantageously presents a 100% tool-free design. As used herein, "snap-fit" connections means resilient connections in which male feature such as a tab, detent, projection, etc. is biased into a mating female feature such as a hole or slot requiring one or both of the male and female features to resiliently and elastically deform to accommodate such a connection.

As another advantage, tray 22 may be readily incorporated into an existing retail shelf 24. Put differently, and unlike prior designs, tray 22 does not require a custom made shelf or custom made vertical display to mount tray 22 to. Instead, a plurality of mounting plates are provided which mate with conventional features on shelf 22 and with tray 22 to hold the same in place on shelf 24. These and other advantages will be readily understood from the following.

Figure 1:
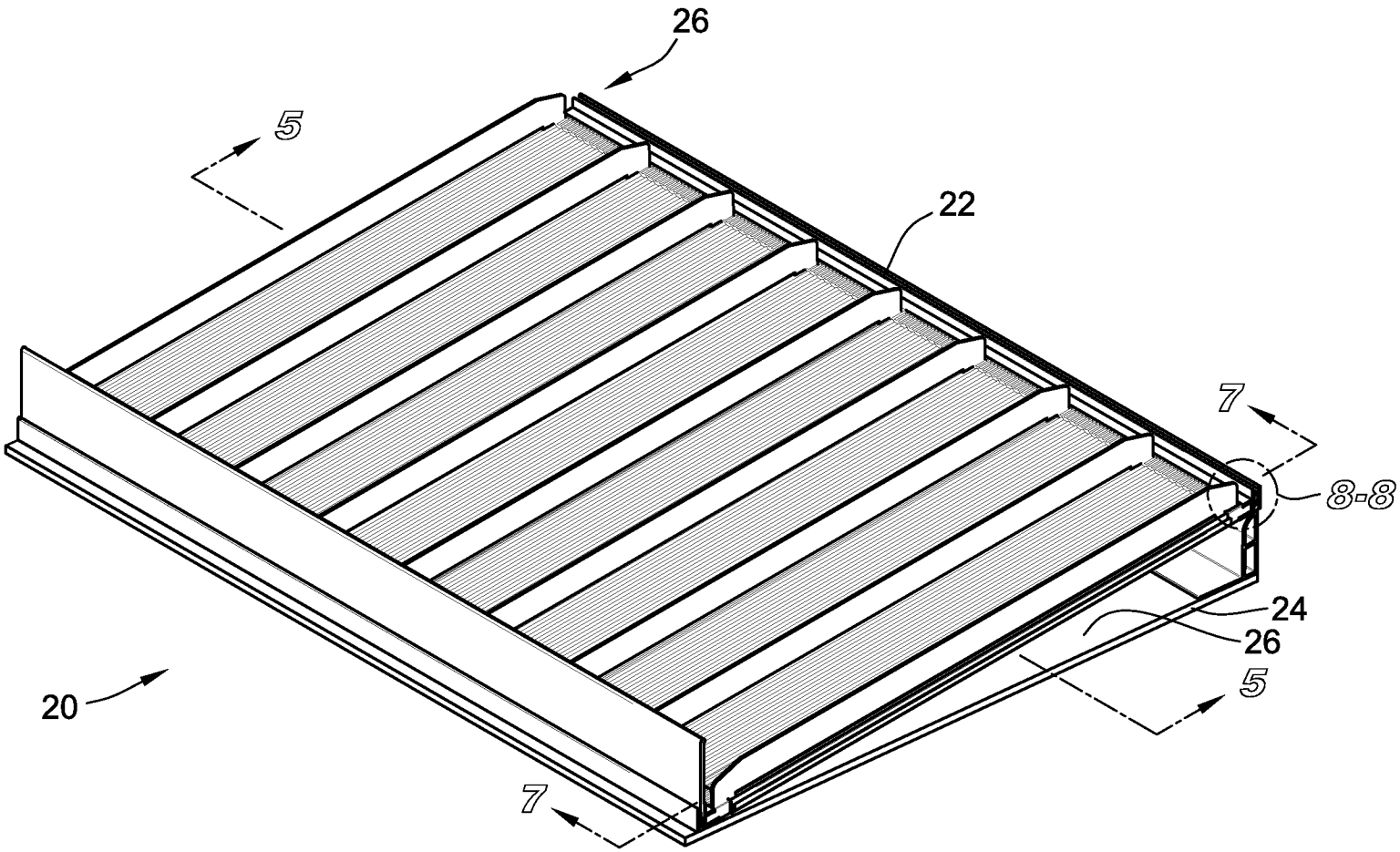
FIG. 1 is a perspective view of an exemplary embodiment of a retail merchandise display according to the teachings herein, the display including a retail merchandise shelf with a tray mounted thereon.
Figure 2:
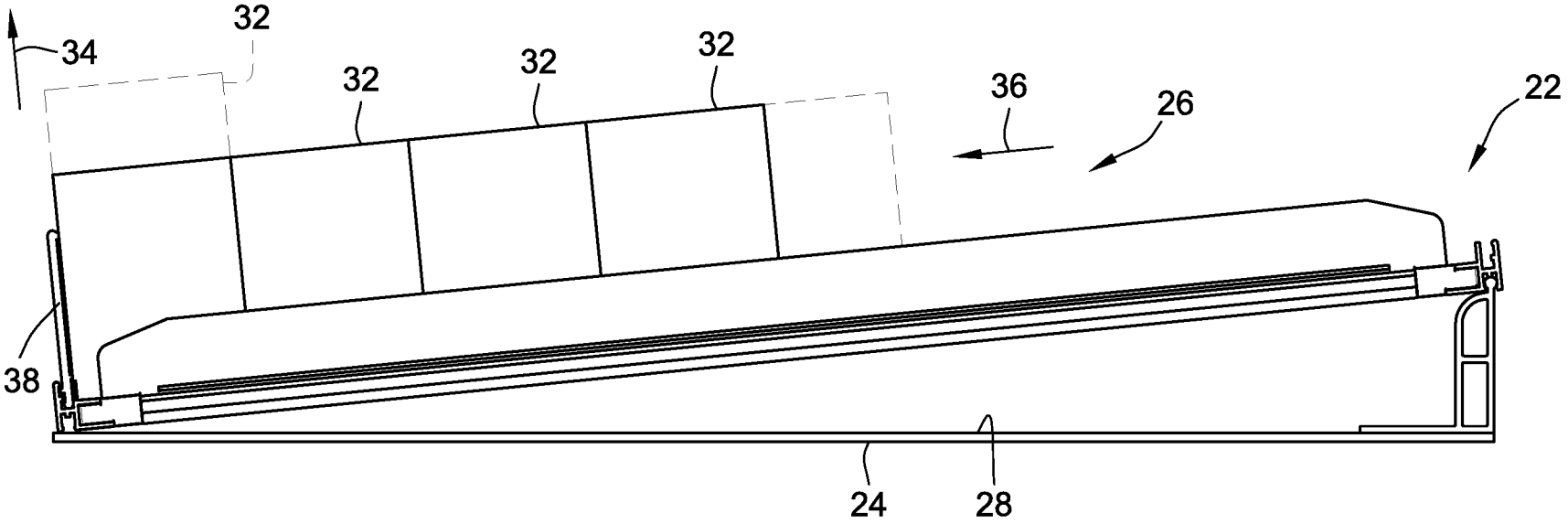
FIG. 2 is a side view of the display of FIG. 1 illustrating the same loaded with exemplary items of merchandise.

With particular reference to FIG. 1, display 20 includes tray 22 mounted on a top surface 28 of shelf 24. Tray 22 defines a plurality of retail merchandise channels 26 which are arranged parallel to one another and extend from a back end 50 of tray 22 to a front end 54 of tray 22. With reference to FIG. 2, channels 26 are arranged to carry items of retail merchandise 32 therein in a linear row. In the illustrated embodiment, tray 22 is in a gravity feed configuration in that its back 50 is elevated relative to its front end 54. Due to the gravity feed configuration of tray 22, as the lead item of merchandise 32 is vertically removed in direction 34, the remaining items of merchandise 32 move forward along a feed direction 36 until the front-most item of retail merchandise 32 abuts a front stop 38. It will be recognized from the teachings herein, however, that tray 22 need not employ the aforementioned gravity feed configuration to face retail merchandise. Instead, tray 22 may utilize a pusher system to bias merchandise toward front end 54. In such a configuration, tray 22 will be generally parallel with shelf 24 such that back end 50 and front end 54 are at the same elevation relative to shelf 24. As yet another alternative, tray 22 may be placed in its gravity feed configuration but nevertheless employ the pusher configuration described herein, depending on the size, weight, and other parameters of the merchandise to be faced.

Figure 3:
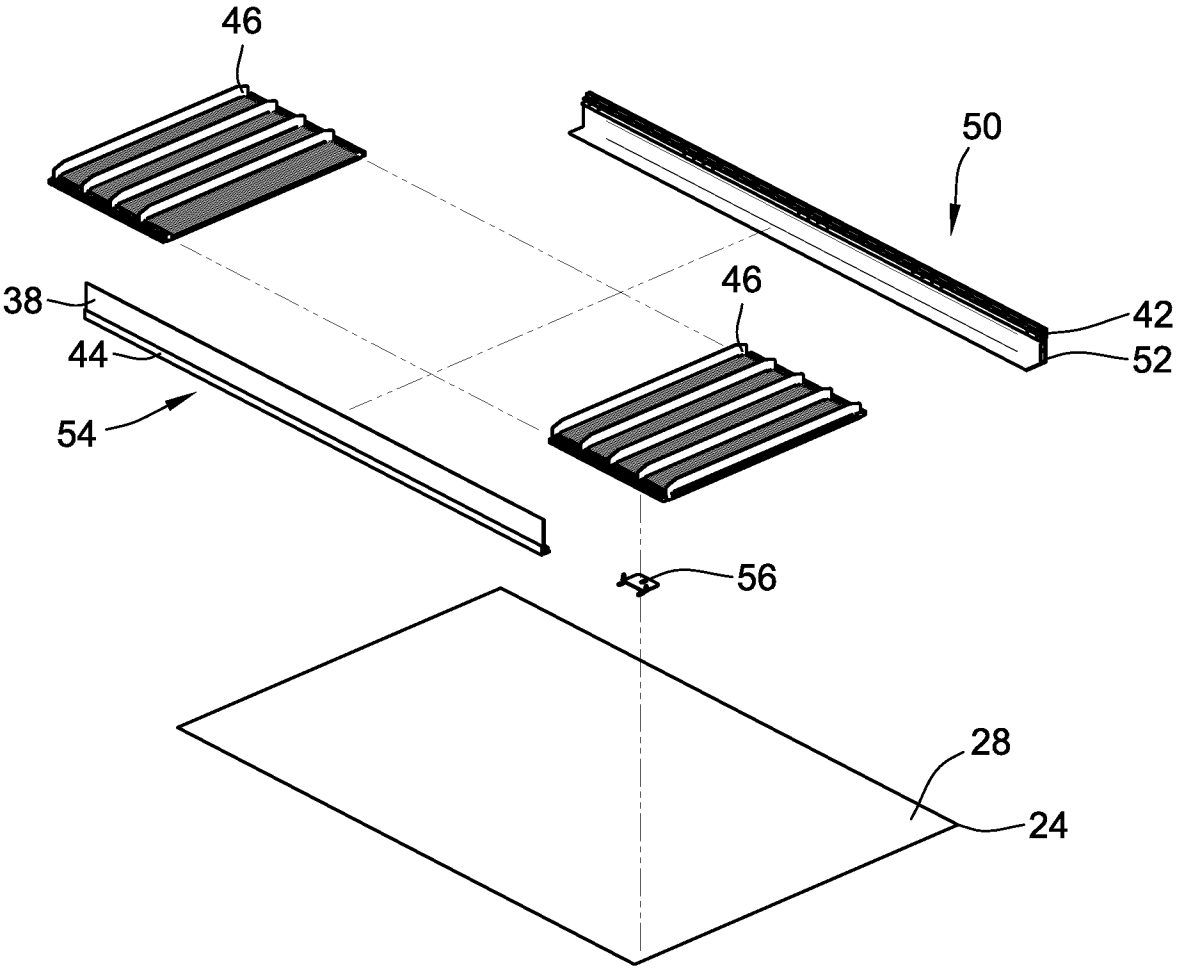
FIG. 3 is a perspective exploded view of the display of FIG. 1.

Turning now to FIG. 3, tray 22 includes a first mounting rail 42 and a second mounting rail 44. At least one tray section 46 is mounted between mounting rails 42, 44. In the illustrated embodiment, two tray sections 46 are utilized. However, a single tray section 46 may be employed, as well as more than two tray sections 46. As will be understood from the following, each tray section 46 is configured to connect to adjacent tray sections as well as to mounting rails 42, 44. Tray 22 also includes a support leg 52 mounted to first mounting rail 42. Support leg 52 raises or elevates back end 50 of tray 22 relative to front end 54 to provide the aforementioned gravity feed functionality. Put differently, support leg 52 angles a retail merchandise support surface defined by tray 22 relative to top surface 28 of shelf 24 such that retail merchandise moves towards front stop 38 under the force of gravity. The height of front stop 38 may be varied to accommodate differing heights of retail merchandise.

Display 20 also includes a plurality of mounting plates 56 which are interposed between shelf 24 and tray 22. Mounting plates 56 include bent portions which are received in apertures 106 formed in shelf 24. As will be discussed in greater detail below, mounting plates 56 also include projection 108 which are received in slots 70 of tray 22 (See FIG. 7). Such a configuration advantageously anchors front end 54 of tray 22 on shelf 24.

It will be recognized by those of skill in the art that shelf 24 may take on any conventional retail shelf form which includes a plurality of apertures formed therein for receipt of bent portions of mounting plates 56. Accordingly, tray 22 is not limited to any particular style of shelf 24 and may be readily retrofit into a variety of existing shelves. Although not shown in FIG. 3, those of skill in the art will also recognize that shelf 24 is typically mounted to an upright structure. Tray 22 is designed so that it does not require any manipulation or modification of such an upright structure and can instead readily interact with shelf 24.

Figure 4:
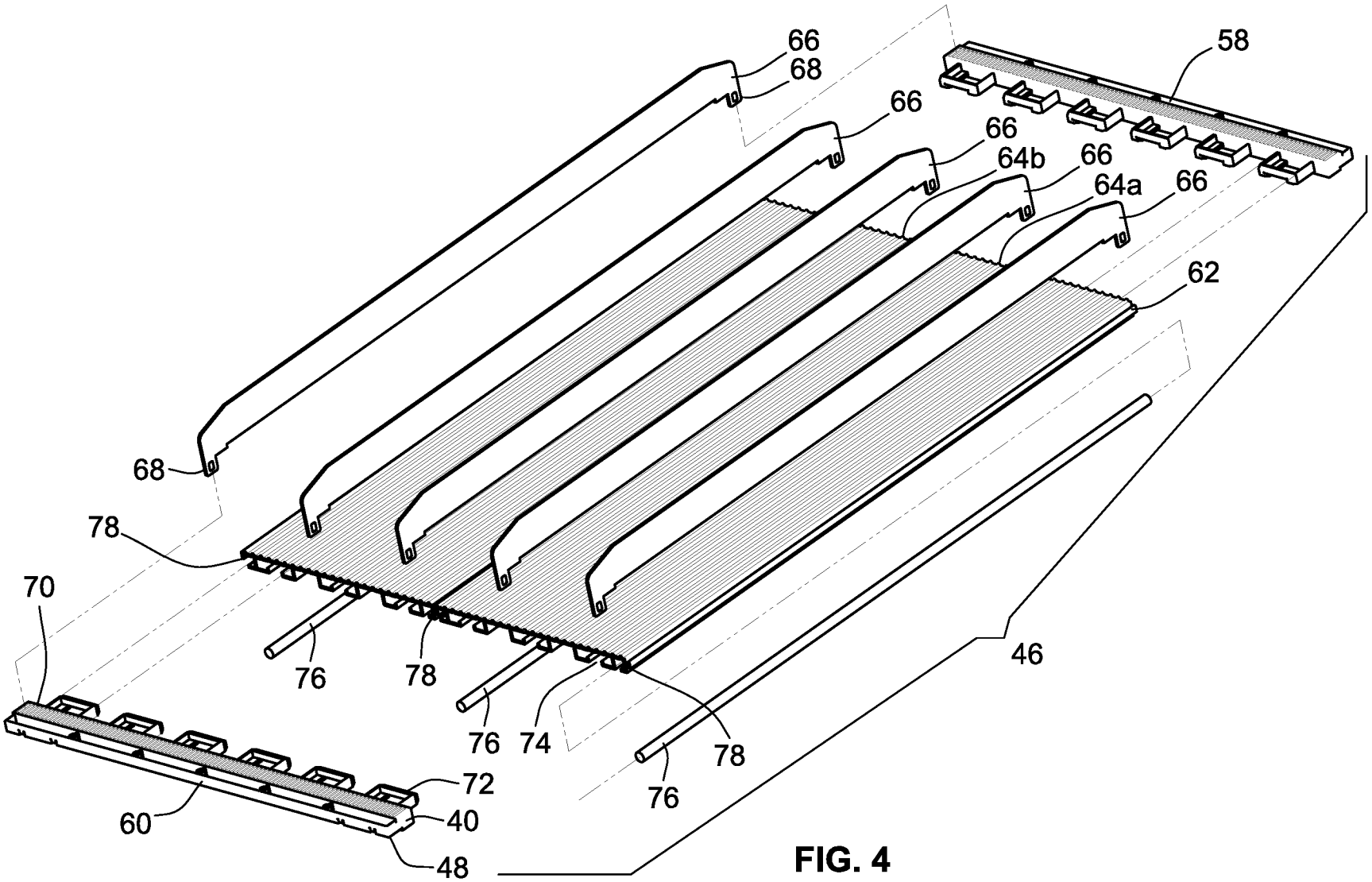
FIG. 4 is a perspective exploded view of a tray section of the tray of FIG. 1.

Turning now to FIG. 4, the various components of the aforementioned tray section 46 will be described in greater detail. Each tray section 46 includes cap members 58, 60 which are mounted to either end of a base member 62. In the illustrated embodiment, cap members 58, 60 are identical to one another. As such, a description of one cap member applies equally well to the other.

Base member 62 is an extruded component which defines a top retail merchandise support surface which is continuous and extends between back end 50 and front end 54 of tray 20. Base member 62 may be any length given the use of the extrusion process in its manufacture. Base member 62 also includes a plurality of channels formed therein as described below. In the illustrated embodiment, base member 62 is formed by two interlocking subsections 64*a*, 64*b*. However, a single base section 62 may be used. In the case of multiple based subsections 64*a*, 64*b*, the same interlock with one another to present a continuous retail merchandise support surface as introduced above. Further, base member 62 may be extruded at a given width, and then subsequently rip cut to its desired width. Base member 62 may be formed of high density polyethylene as one example. In view of the foregoing, it will also be recognized that the width of cap members 58, 60 may also vary depending on the width of base member 62.

A plurality of dividers 66 extend over the retail merchandise support surface defined by base member 62 and include downwardly extending projections 68 which are received in select ones of the aforementioned linear row of slots 70. The close spacing of the slots allows for a high degree of variability of the width of any given channel 26 by spacing dividers 66 closer or farther away from one another. These dividers 66 may be embodied as shown as generally flat walls, or alternatively, my incorporate a pusher assembly as described below relative to FIGS. 9 and 10. Further, the dividers 66 are easily removable such that tray 22 may be utilized with only a single divider, or no dividers at all. Still further, wire dividers may be utilized instead of the plate-like elements illustrated. Still further, dividers 66 may be any height to accommodate merchandise of differing heights.

As can be seen in FIG. 4, slots 70 are formed in each cap member 58, 60 and extend entirely through the same. Slots 70 are arranged in a linear row which is perpendicular to feed direction 36 (See FIG. 2) of tray 22 and are formed in a body portion 40 of each cap member 58, 60. Each cap member 58, 60 also includes a plurality of projections 72 extending away from body portion 40 which are received in corresponding channels 74 of base member 62 as illustrated. Additionally, a plurality of wire supports 76 are received in channels 78 of base member 62. Wire supports 76 provide additional rigidity and structural support to base member 62. Those of skill in the art will recognize that wire support 76 may be omitted entirely in the event that generally light merchandise will be carried by tray 22. Conversely, wire support 76 may be tailored using different materials and dimensions to vary the structural support provided thereby.

Figure 5:
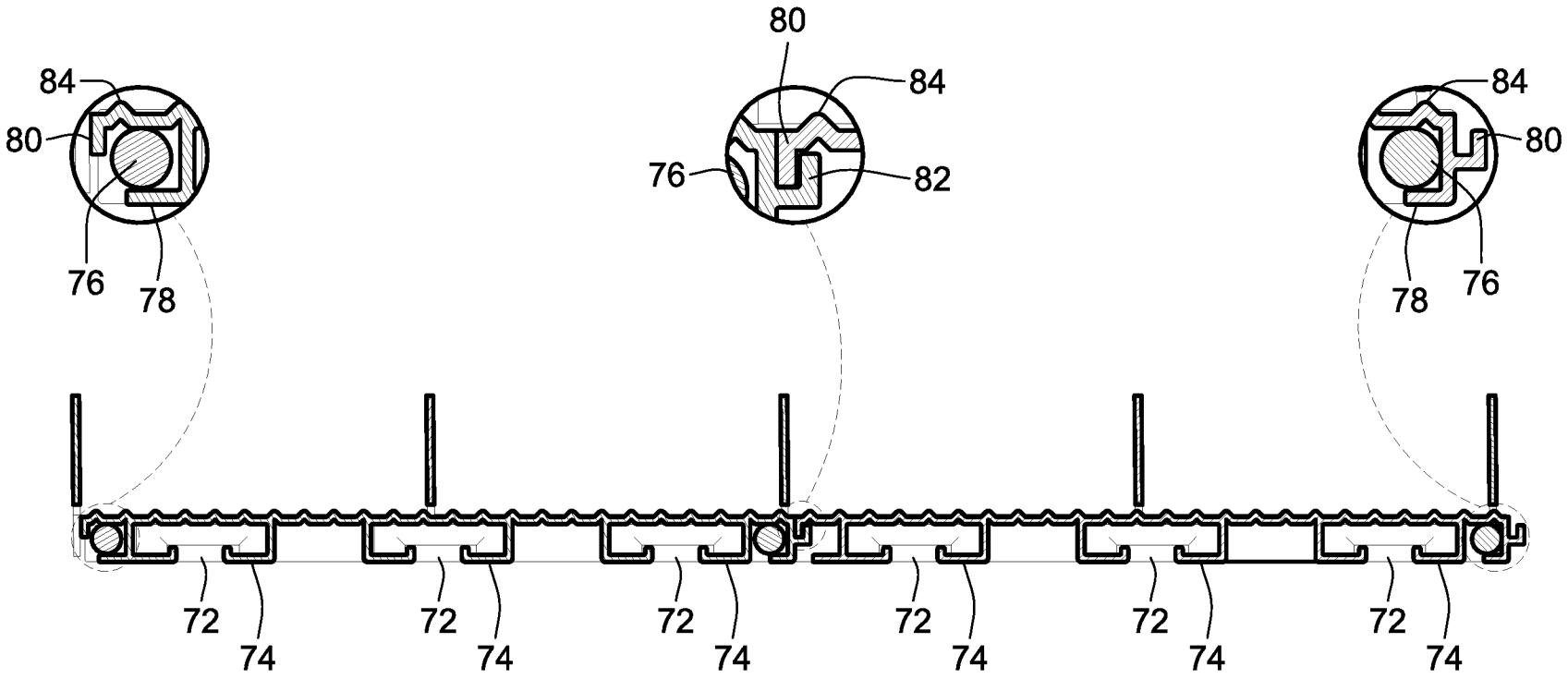
FIG. 5 is a cross section of the tray section of FIG. 4.

Turning now to FIG. 5, the same illustrates a cross-section taken through tray section 46. As can be seen in this view, the projection 72 of cap member 58 are shown installed within channel 74. Similarly, wire supports 76 are shown installed within channel 78. Also shown in FIG. 5 is the interlocking capabilities of base member 62. Indeed, subsection 64*a* includes an upwardly facing channel 82 on the right-most side thereof in FIG. 5. Subsection 64*b* is identical to subsection 64*a* and thus also includes an upwardly facing channel 82 on the right-most side thereof in FIG. 5. Each subsection 64*a*, 64*b* also includes a downwardly depending rib 80 on the left-most side thereof shown in FIG. 5. This rib 80 is configured to be received within upwardly facing channel 82 to interlock subsection 64*a* with subsection 64*b*. Likewise, this channel 82 and rib 80 configuration is also utilized to interlock adjacent tray sections 46 to one another.

Figure 6:
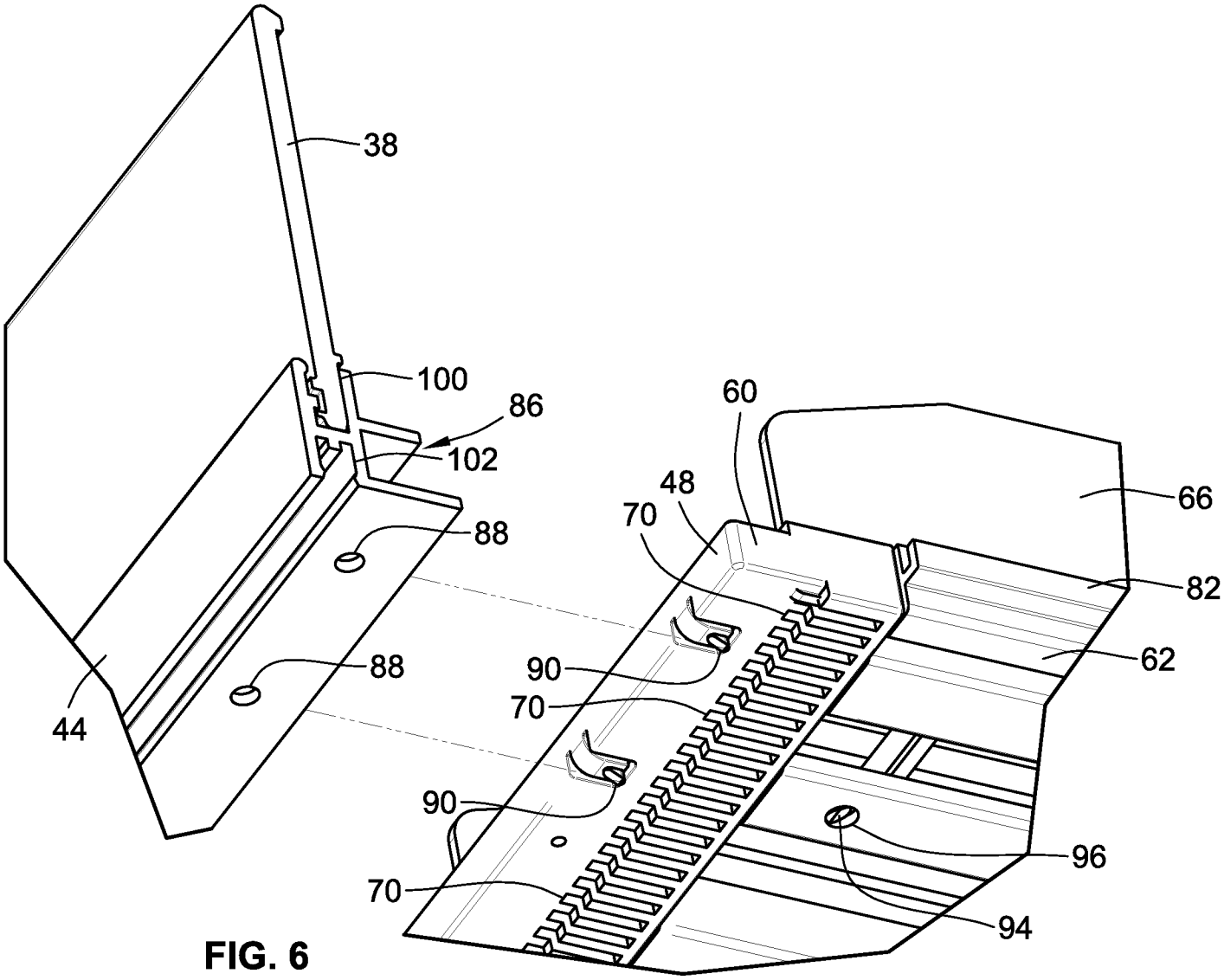
FIG. 6 is a partial perspective exploded view of the tray section of FIG. 4.

Turning now to FIG. 6, the resilient snap-fit connection between each tray section 46 and mounting rails 42, 44 is shown. Also, the resilient snap-fit connection between each cap member 58, 60 and base member 62 is shown. In particular, FIG. 6 illustrates the snap-fit connection between cap member 60 and second mounting rail 44 as well as cap member 60 between base member 62. It will be recognized that the following description of the aforementioned snap-fit connection applies equally well to cap member 58 and first mounting rail 42 as well as cap member 58 and base member 62. Further, the description of the structural attributes of second mounting rail 44 shown in FIG. 6 applies equally well to first mounting rail 42 as mounting rails 42, 44 are identical. Because of this identical construction, it is possible to utilize a front stop 38 with mounting rail 42 in the same manner as that shown with mounting rail 44. Such a configuration is advantageous in front load configurations to prevent the rear-most item of merchandise from falling off of the back of tray 22.

Second mounting rail 44 includes a horizontally extending mounting channel 86. Second mounting rail 44 also includes an upper channel 100 and a lower channel 102 which extend generally perpendicular to mounting channel 86. Mounting channel 86 includes a plurality of apertures 88 formed therein. Apertures 88 are arranged to receive tabs 90 formed in a projection portion 48 of cap member 60. Tabs 90 are received within apertures 88 via a resilient snap-fit connection in that one or both of tabs 90 or the wall defining channel 86 including apertures 88 elastically deforms as projection portion 48 is biased into mounting channel 88. This continues until tabs 90 are fully seated within apertures 88 and cap member 60 is thus locked to mounting rail 44.

A similar snap-fit connection takes place between cap member 60 and base member 62. Indeed, base member 62 includes an aperture 96 into which a projection 94 formed on one of the projections 72 of cap member 60 seats into. As was the case with second mounting rail 44 and tabs 90, one or both of tab 94 and base member 62 in the region of aperture 96 elastically deforms until tab 94 is fully seated within aperture 96.

Figure 7:
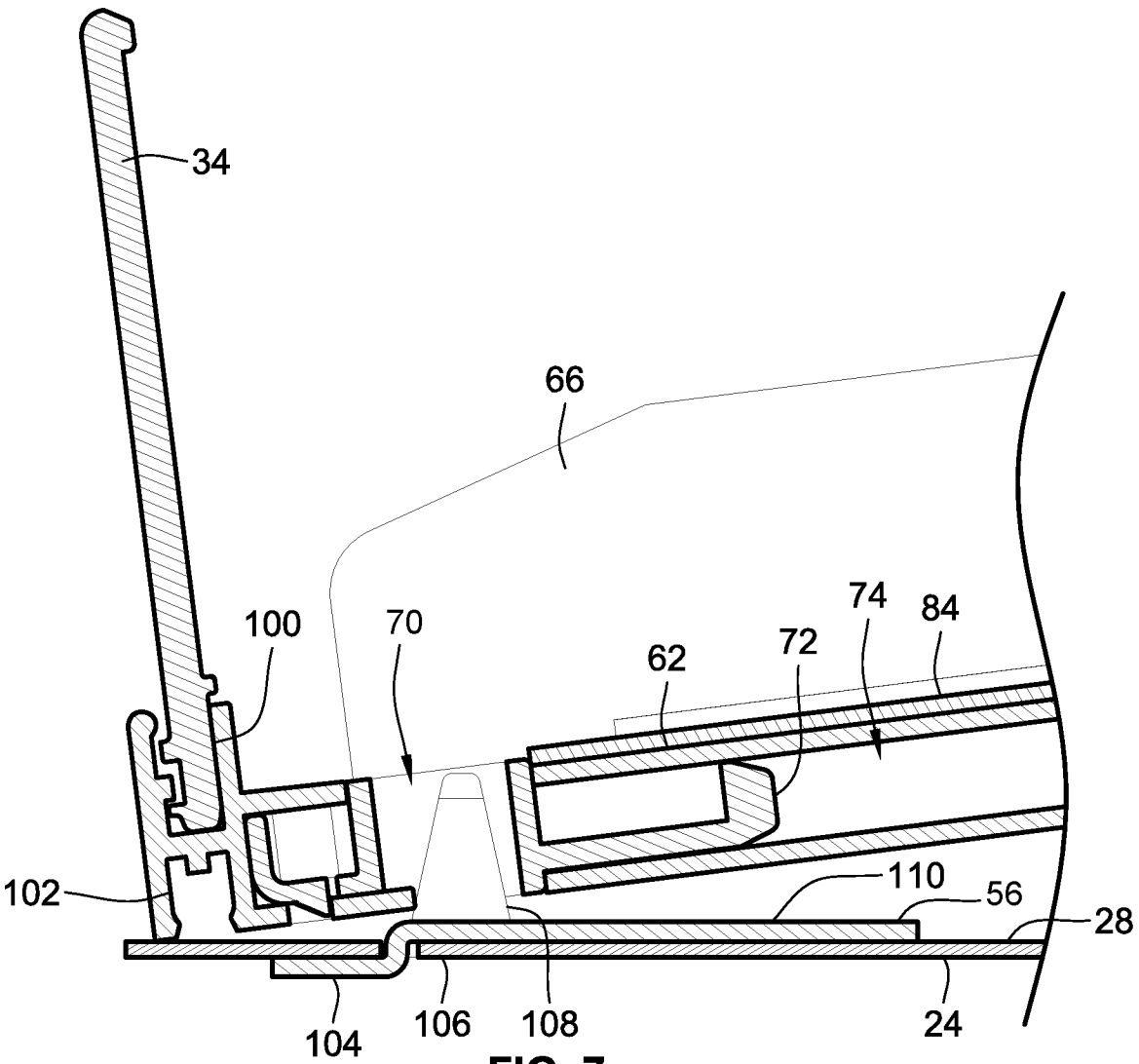
FIG. 7 is a partial cross section of the display of FIG. 1.

Turning now to FIG. 7, the same illustrates the mounting of mounting plate 56 relative to shelf 24 and relative to tray 22. As stated above, mounting plate 56 includes bent portions 104. Bent portions 104 may be fed through apertures 106 formed in shelf 24. As can be seen in FIG. 7, bent portions 104 extend away from a base portion 110 of mounting plate 56. Further, each mounting plate 56 includes a pair of bent portions 104 which are coplanar with one another but are not coplanar with base portion 110 as shown. As also described above, a projection 108 extends upwardly from base portion 110 and is received within a select one of slot 70. Each mounting plate 56 may include a single projection 108 or multiple projections 108.

Figure 8:
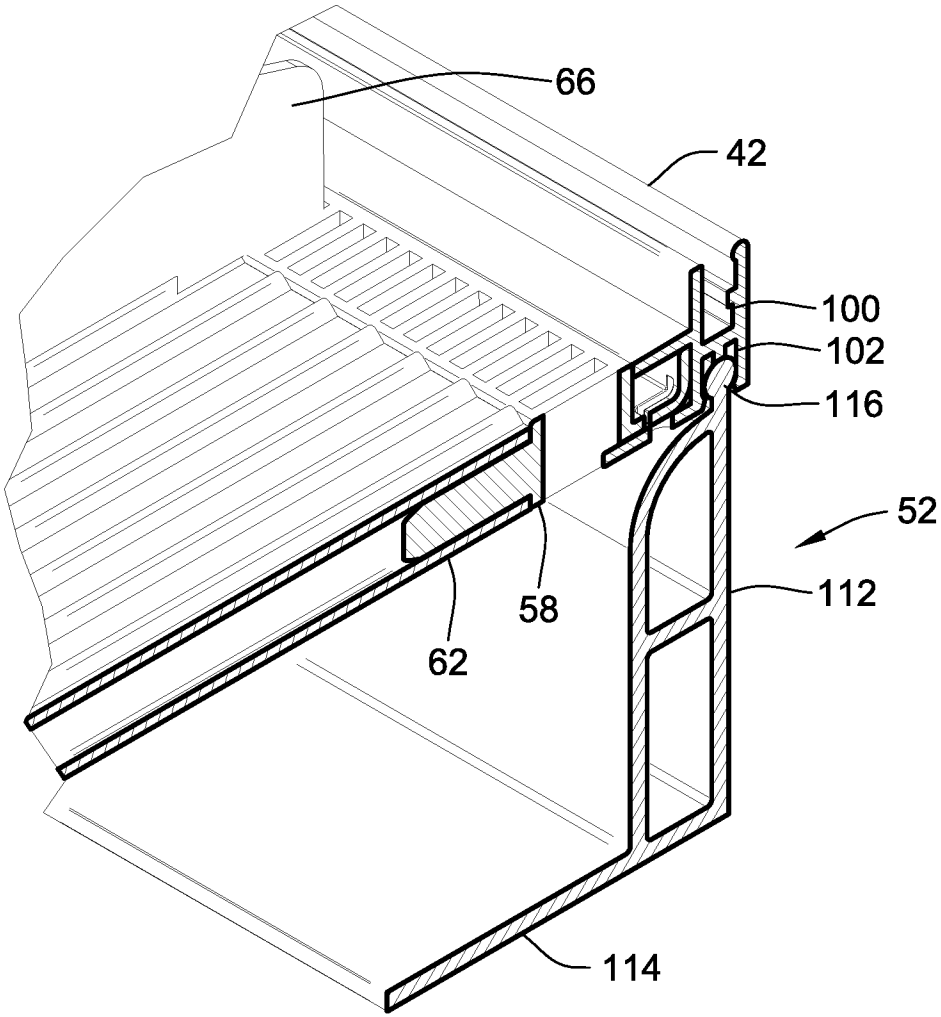
FIG. 8 is a partial perspective view of the display of FIG. 1.

Turning now to FIG. 8, the snap-fit connection between support leg 52 and first mounting rail 42 is illustrated. As can be seen in this view, support leg 52 includes a generally vertical leg portion 112 with a foot portion 114 extending perpendicularly to leg portion 112. A projection 116 is formed at a top end of leg portion 112. This projection 116 has a generally circular cross-sectional profile and is received via a snap-fit connection in lower channel 102 of first mounting rail 42. Lower channel 102 may include undercut or ribs for securing projection 116 once it is fully inserted within channel 102. The round outer profile of projection 116 allows support leg 52 to rotate about its longitudinal axis within channel 102 to achieve a desired angle of support leg 52 relative to the remainder of tray 22. The length of vertical leg portion 112 may be varied as well to obtain a desired angle of tray 22 relative to shelf 24.

Figure 9:
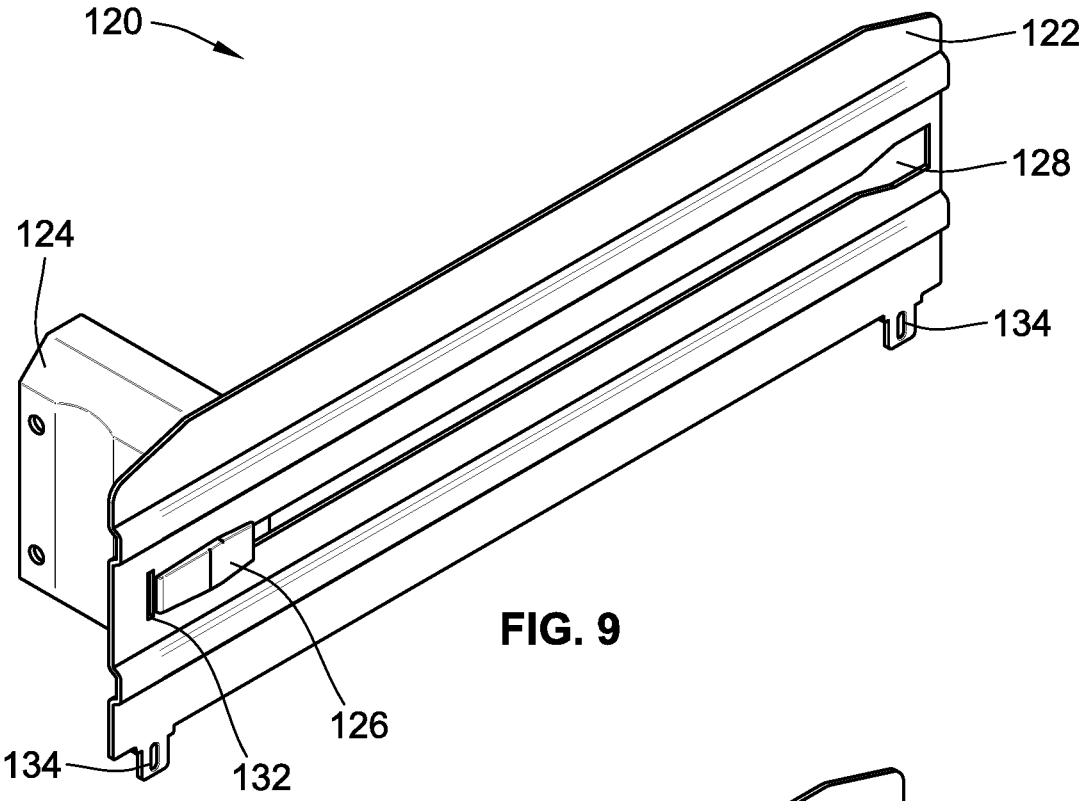
FIG. 9 is a perspective view of an alternative embodiment of a divider associated with the tray of FIG. 1.

Turning now to FIG. 9, an alternative embodiment of a divider 120 is illustrated. Unlike divider 66 described above, divider 120 includes an integrated pusher assembly. The integrated pusher assembly includes a divider wall 122 with a pusher paddle 124 slidably mounted thereto. Pusher paddle 124 includes a projection 126 which is received in a channel 128 of divider wall 122 to effectuate the aforementioned slidable connection.

Figure 10:
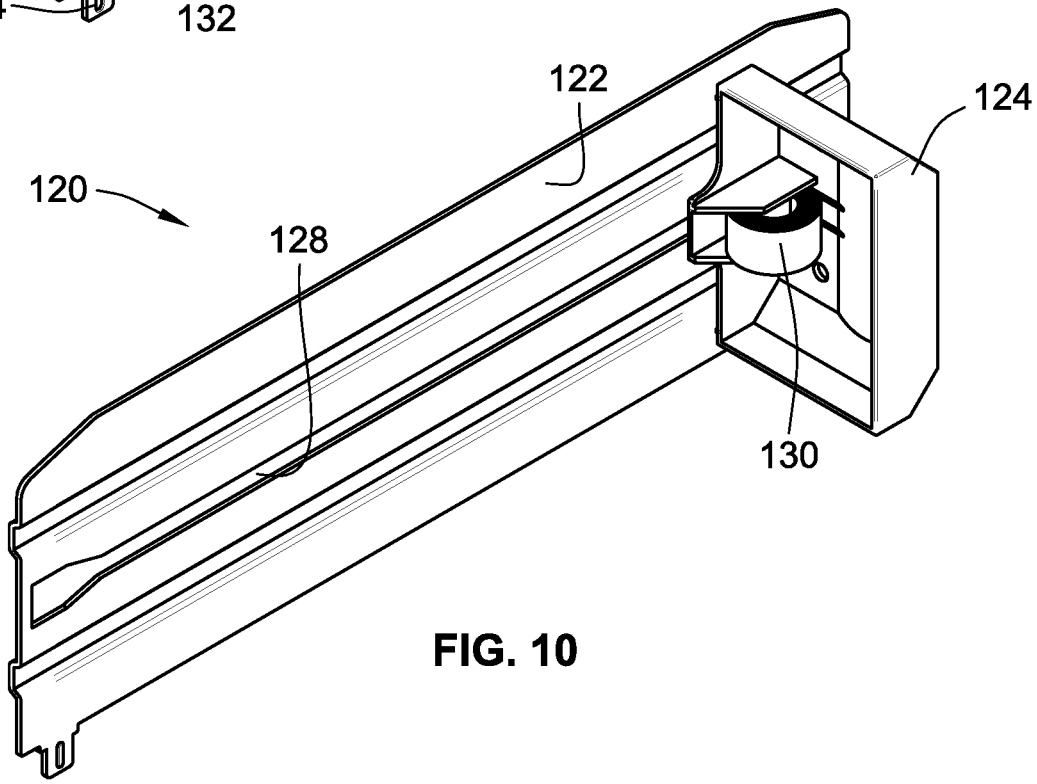
FIG. 10 is another perspective view of the divider of FIG. 9.

With reference to FIG. 10, the pusher assembly also includes a coil spring which is uncoiled through the front of pusher paddle 124 and connected to divider wall 122 at a slot 132 thereof (see FIG. 9). The remainder of coil spring 130 remains coiled and contained within pusher paddle 124 as shown. Turning back to FIG. 9, divider wall 122 also includes downward projections 134 which are received in slots 70 in the same manner as described above.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tray for use in a retail merchandise display, the tray comprising:

a base member defining a top support surface for storing retail merchandise thereon, the base member extending between opposed front and rear ends of the base member, the base member comprising a plurality of rails underneath the top support surface; the rails defining a plurality of channels therebetween, the channels extending generally parallel to a feed direction of the tray; the top support surface includes a plurality of upwardly extending ribs, adjacent ribs of the plurality of ribs forming grooves therebetween, the ribs extending generally parallel to the feed direction; the top surface, the ribs, and the rails forming a continuous structure;

a pair of cap members attached to the base member with the base member being interposed between the pair of cap members such that a first cap member from the pair of cap members is removably attached to the front end of the base member and a second cap member from the pair of cap members is removably attached to the rear end of the base member, wherein:

each cap member includes a body portion having a linear row of slots extending therethrough, each row being generally perpendicular to the feed direction, each slot being elongated generally parallel to the feed direction;

each cap member includes a plurality of projections extending away from each body portion respectively, each projection including:

leg portions extending generally parallel to the feed direction, the leg portions being spaced apart;

a connection portion extending between and connecting the leg portions, the leg portions and the connection portion define a generally U-shaped projection defining an opening, the opening located between the connection portion and a corresponding body portion;

each projection being received in a corresponding channel of the plurality of channels to secure each cap member to the base member.

2. The tray of claim 1, further comprising a mounting rail, the mounting rail being snap-fit connected to one of the cap members.

3. The tray of claim 1, wherein each cap member includes at least one elastically deformable tab formed in each body portion respectively.

4. The tray of claim 3, wherein for each cap member:

the linear row of slots is positioned between the projections and the at least one elastically deformable tab.

5. The tray of claim 1, wherein each projection of the plurality of projections includes opposed tapered surfaces, the opposed tapered surfaces of each projection taper away from one another from a distal end of each projection towards the body portion of each cap member respectively.

6. The tray of claim 5, wherein one of the tapered surfaces of each projection generally faces the top support surface and the other tapered surface of each projection generally faces away from the top support surface.

7. The tray of claim 1, wherein the cap members are each secured to the base member by a resilient snap-fit connection.

8. The tray of claim 7, wherein:

at least one projection from the plurality of projections of each cap member includes a tab projecting from the at least one projection of each cap member;

the base member includes at least one aperture proximate each of the front end and the rear end respectively, the at least one aperture proximate the front end receives the tab of the least one projection of the first cap member removably attached to the front end; and the at least one aperture proximate the rear end receives the tab of the least one projection of the second cap member removably attached to the rear end.

9. The tray of claim 8, wherein each tab is inserted within a corresponding aperture.

10. The tray of claim 1, wherein each cap member comprises a protrusion, each row of slots being interposed between each protrusion and the base member respectively along the feed direction.

11. The tray of claim 1, wherein each rail has a downwardly extending leg and a laterally extending foot, wherein corresponding feet of a pair of rails from the plurality of rails extend towards one another, the corresponding feet being in laterally spaced and defining a gap between distal ends of the corresponding feet.

12. The tray of claim 1, wherein:

the distal end of each corresponding foot being upturned and extending upward towards the top support surface; the corresponding feet and the legs forming grooves;

the leg portions of each projection are received in corresponding grooves of corresponding rails associated with each channel respectively.

13. The tray of claim 10, further comprising a mounting rail, the mounting rail being attached to one of the cap members, the mounting rail defining the downward opening channel.

14. The tray of claim 1, further including at least one divider extending over the base member and inserted into corresponding slots of the cap members.

15. The tray of claim 1, wherein the cap members are identical.

16. The tray of claim 1, wherein the slots of each cap member are configured to receive portions of dividers therein.

* * * * *